US005711104A

United States Patent [19]

Schmitz

[11] Patent Number: 5,711,104

[45] Date of Patent: Jan. 27, 1998

[54] SMALL ARMS VISUAL AIMING SYSTEM, A METHOD FOR AIMING A FIREARM, AND HEADGEAR FOR USE THEREWITH

[76] Inventor: Geoffrey W. Schmitz, 413 LaSalle St., Wausau, Wis. 54403

[21] Appl. No.: 769,123

[22] Filed: Dec. 19, 1996

[51] Int. Cl.[6] ..... F41G 1/46

[52] U.S. Cl. ..... 42/100; 42/106

[58] Field of Search ..... 42/100, 106

[56] References Cited

U.S. PATENT DOCUMENTS

| | | | |
|---|---|---|---|
| 1,955,300 | 4/1934 | Kurnick | 95/12 |
| 2,282,680 | 5/1942 | Sonne | 95/12 |
| 3,545,356 | 12/1970 | Nielsen | 95/12 |
| 4,008,478 | 2/1977 | Ikrath et al. | 343/720 |
| 4,516,157 | 5/1985 | Campbell | 358/108 |
| 4,605,959 | 8/1986 | Colbaugh | 358/93 |
| 4,703,879 | 11/1987 | Kastendieck et al. | 224/181 |
| 4,786,966 | 11/1988 | Hanson et al. | 358/108 |
| 4,884,137 | 11/1989 | Hanson et al. | 358/108 |
| 4,936,190 | 6/1990 | Pilcher, II | 89/41.05 |
| 5,005,213 | 4/1991 | Hanson et al. | 455/617 |
| 5,026,158 | 6/1991 | Golubic | 356/252 |
| 5,054,225 | 10/1991 | Giuffre et al. | 42/101 |
| 5,129,716 | 7/1992 | Holakovsky et al. | 351/50 |
| 5,200,827 | 4/1993 | Hanson et al. | 358/211 |
| 5,386,308 | 1/1995 | Michel et al. | 359/83 |
| 5,583,571 | 12/1996 | Friedland | 348/373 |

OTHER PUBLICATIONS

RGB Spectrum *Videographics Report*, Spring 1996, p.2.

"Helmet mounted sight ODEN" Dec. 12, 1996, pp. 1–3.

"Helmet–Mounted Sight Demonstrator," brochure by DCIEM, p.1–2 and 1.

"Tactical Video System" from Product Showcase, *Photo–Electronic Imaging*, Jul. 1993, p. 52.

*Primary Examiner*—Charles T. Jordan
*Assistant Examiner*—Meena Chelliah
*Attorney, Agent, or Firm*—Hill, Steadman & Simpson

[57] ABSTRACT

An aiming system and a method for aiming a firearm are provided that allow a user to aim and shoot the firearm without exposing the body of the user to potential enemy fire or the like. The visual aiming system is incorporated on a body of the firearm and an image signal is remotely transmitted to a headset worn by the firearm user. The headset has an incorporated display to view the image. The image signal may be recorded or remotely observed through additional transmission of the image signal from the camera.

16 Claims, 3 Drawing Sheets

SMALL ARMS VISUAL AIMING SYSTEM, A METHOD FOR AIMING A FIREARM, AND HEADGEAR FOR USE THEREWITH

BACKGROUND OF THE INVENTION

The present invention generally relates to a system and a method for aiming a firearm. More specifically, the present invention relates to a system and a method for visually aiming a firearm by a user at a position remote from the firearm, as well as headgear for use with such a system and method.

It is, of course, generally known to provide a firearm with an aiming system, such as a sight guide or view finder. Typically, a firearm is aimed by resting the firearm on or at a shoulder of the user. The firearm often includes a view finder that assists in accurate aiming of the firearm. Such a system, however, requires the user to focus his vision through the view finder at all times in order to aim the firearm.

Furthermore, current aiming systems used with conventional firearms require the user to expose himself to the environment in which the firearm is used. As a result, the current aiming mechanisms known for use with firearms prevent accurate shooting of the firearm around a corner, for example, while holding the firearm at a distance.

Therefore, an improved aiming system and method are required that overcome the deficiencies of known systems, as well as headgear to be used with the system and method.

SUMMARY OF THE INVENTION

The present invention provides a system and a method for aiming a firearm. More specifically, the present invention provides a system and a method for aiming a firearm without requiring the firearm to be positioned in the field of view of the user. The present invention further provides headgear to be worn by a user of the firearm.

To this end, in an embodiment of the present invention, an aiming system is provided. The aiming system includes a firearm having a barrel and a camera mounted to the firearm along an axis parallel to the barrel. Transmission means is associated with the camera for transmitting an image from the camera. Display means remote from the transmission means is provided for viewing the transmitted image.

In an embodiment, goggles on which the display means is attached are provided wherein the goggles are worn by an individual carrying the firearm.

In an embodiment, a helmet is provided on which the display means is attached wherein the helmet is worn by an individual carrying the firearm.

In an embodiment, a cable is provided between the transmission means and the display means for transmitting the image.

In an embodiment, an antenna is attached to the camera, and a receiver means is attached to an individual carrying the firearm to receive a signal transmitted by the antenna relating to the image from the camera.

In an embodiment, memory means is provided for storing the image transmitted from the camera.

In an embodiment, surveillance means is provided remote from the firearm capable of receiving the image from the camera.

In an embodiment, a switch is connected to the firearm that selectively initiates operation of the camera.

In an embodiment, vision through the goggles is only partially obstructed by the display means.

In an embodiment, the camera is removable from the firearm for attachment to another firearm.

In another embodiment of the present invention, a method is provided for aiming a firearm carried by a user. The method comprises the steps of: providing a camera; attaching the camera to the firearm providing a line of sight and an image signal corresponding thereto; transmitting the image signal from the camera; and displaying the image signal transmitted at a location remote from the camera.

In an embodiment, headgear is provided worn by the user of the firearm wherein the transmitted image signal is displayed proximate the headgear. The headgear may be goggles, a helmet or other head mounted apparel.

In an embodiment, the transmitted image signal is recorded for subsequent playback.

In an embodiment, the image signal is monitored at a remote location from the firearm and the user.

In an embodiment, selective activation of the camera is provided.

In an embodiment, transmission is via wireless transmission.

In another embodiment of the present invention, a headset is provided for use with a visual aiming system attached to a firearm for use by an operator. The headset has an article attached to a head of the operator and a display operatively connected to the article wherein the display is capable of receiving an image signal from the visual aiming system attached to the firearm.

In an embodiment, the article is goggles that enclose eyes on the head of the operator.

It is, therefore, an advantage of the present invention to provide an aiming system and method that allow a user to aim and discharge a weapon with minimum exposure to enemy fire and/or observation.

Another advantage of the present invention is to provide a visual aiming system and method that is adaptable to all direct firearms including, but not limited to, rifles, pistols, machine guns, sub-machine guns, assault rifles, rocket launchers and the like.

A still further advantage of the present invention is to provide an aiming system and method that permit surveillance in areas inaccessible to a user.

Yet another advantage of the present invention is to provide an aiming system and a method that permits surveillance in areas not subject to enemy observation, i.e. windows, doorways, holes, caves, around corners, and the like.

A still further advantage of the present invention is to provide an aiming system and method that reduces fatigue of the user from holding the firearm on which the aiming system is mounted.

And, another advantage of the present invention is to provide an aiming system and method that improves accuracy when shooting in locations not in the field of view of the user.

A still further advantage of the present invention is to provide an aiming system and method for firing heavy firearms.

Moreover, an advantage of the present invention is to provide an aiming system and method that allows the firearm to be fired with the operator looking in a direction other than toward the target location.

A still further advantage of the present invention is to provide an aiming system and method that records the viewed image for future reference.

Yet another advantage of the present invention is to provide an aiming system and method that allow the user to monitor the weapon site picture while moving.

And, another advantage of the present invention is to provide an aiming system and method in which the firearm may be held away from the body preventing impact with the body from recoil or contact with a high temperature weapon after firing.

These and other advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
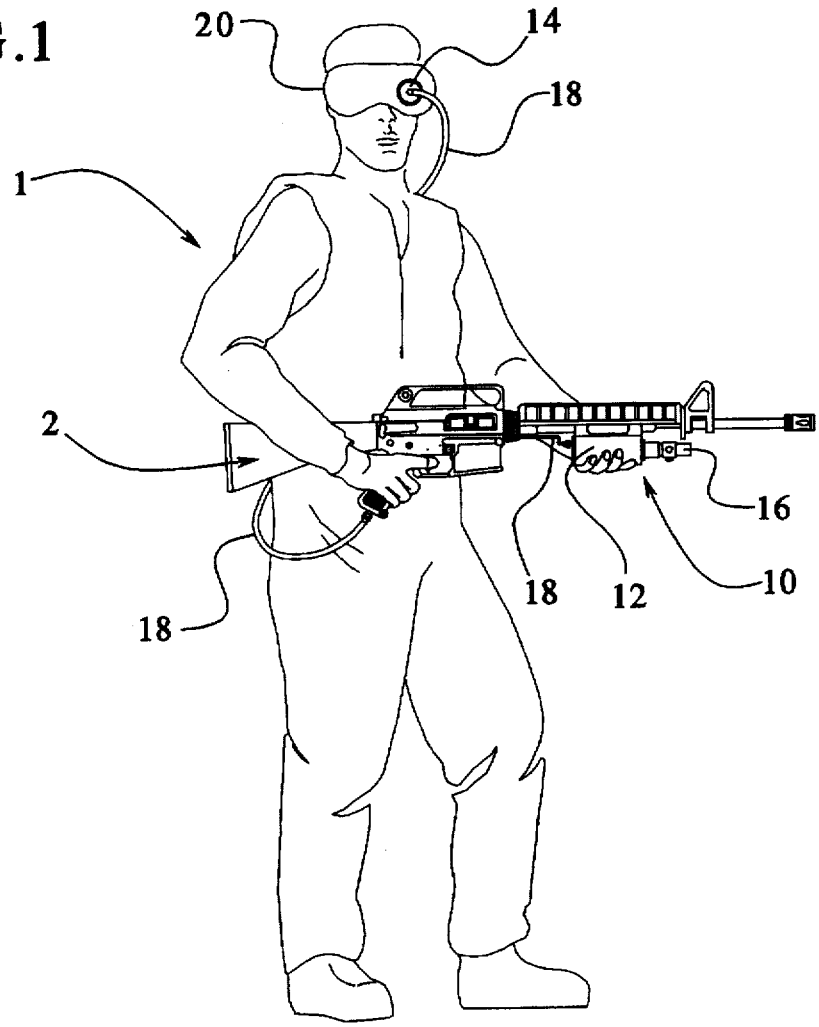
FIG. 1 illustrates a perspective view of a user carrying a firearm incorporating an embodiment of the aiming system of the present invention.

Referring now to the drawings wherein like numerals refer to like parts, FIG. 1 illustrates a user or operator 1 carrying a firearm 2 on which an embodiment of a visual aiming system 10 is mounted. The visual aiming system 10 includes two primary components: a camera 12 and a display 14. Preferably, a high resolution CCD camera, such as the CCD camera model V1056 manufactured by Marshall Electronics, Inc., is incorporated with the visual aiming system 10. A lens 16 is preferably attached to the camera 12 or may be incorporated therein for providing both high resolution video microscope objectives and a close-up or standard verifocal zoom.

As illustrated, the camera 12 is attached to a line of coaxial cable 18 for transmitting an image viewed by the camera 12 and/or the lens 16. The coaxial cable 18 remotely transmits the image to the display 14 mounted on, for example, goggles 20 worn by the user 1.

Figure 2:
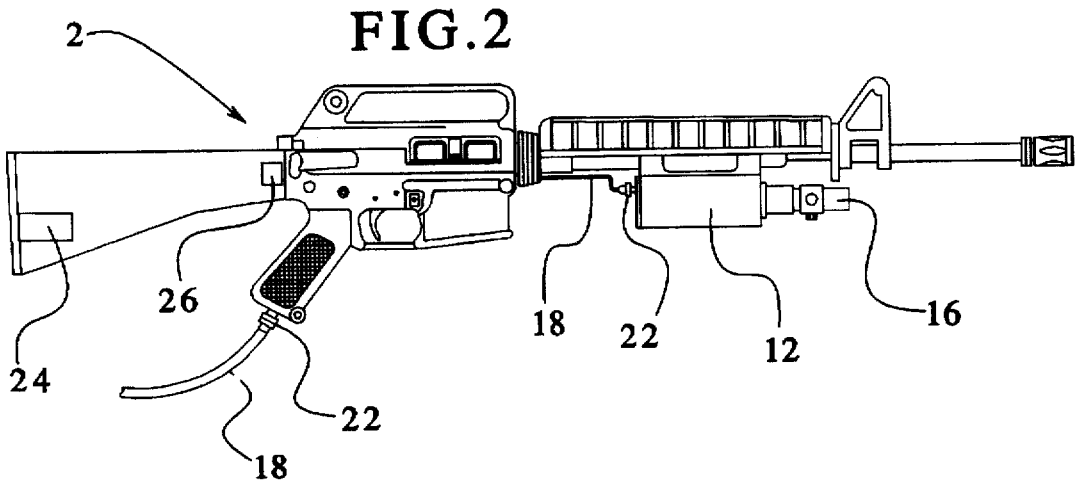
FIG. 2 illustrates a plan view of a firearm incorporating an embodiment of the aiming system of the present invention.

A close-up, enlarged view of the firearm 2 is illustrated in FIG. 2. As shown, the firearm 2 has operatively attached thereto the camera 12 with incorporated or separately attached lens 16. The camera 12 is mounted to the firearm 2 such that it can be easily removed therefrom. Any conventional means for attaching and removing the camera 12 to the firearm 2 may be implemented by those skilled in the art.

The coaxial cable 18 may also be connected to the firearm 2 as generally shown in FIG. 2. Again, conventional connecting mechanisms may be implemented by those skilled in the art to connect and disconnect the coaxial cable 18.

A power supply 24 for the system 10 may be incorporated into a body of the firearm 2 as illustrated in FIG. 2. The power supply 24 provides power necessary for operation of the system 2. A switch 26 may further be provided for activating the system 10 at desired times. Following use, the switch 26 may also deactivate the system 10. A timer may also be incorporated for programmed activation and deactivation of the system 10.

Figure 3:
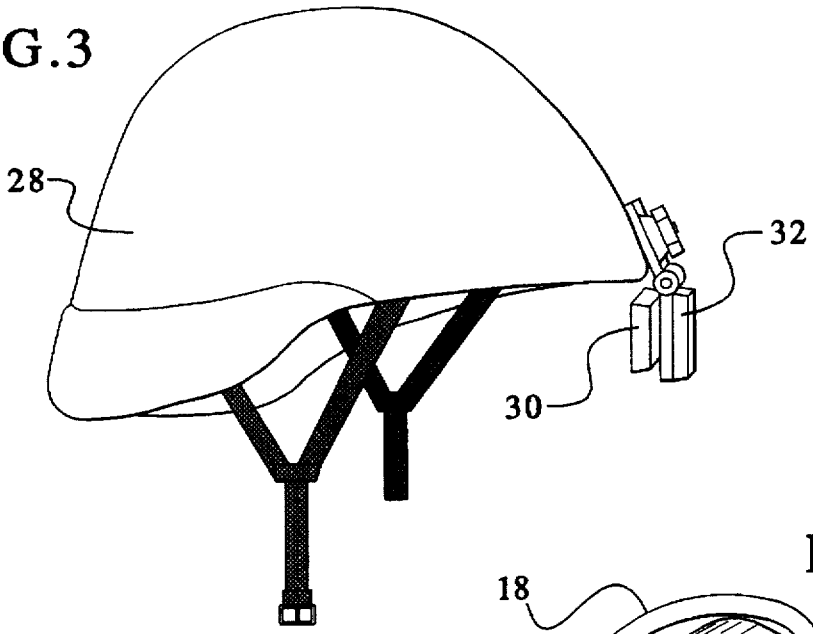
FIG. 3 illustrates a plan view of a visual display mounted to a helmet in an embodiment of the present invention.
Figure 4:
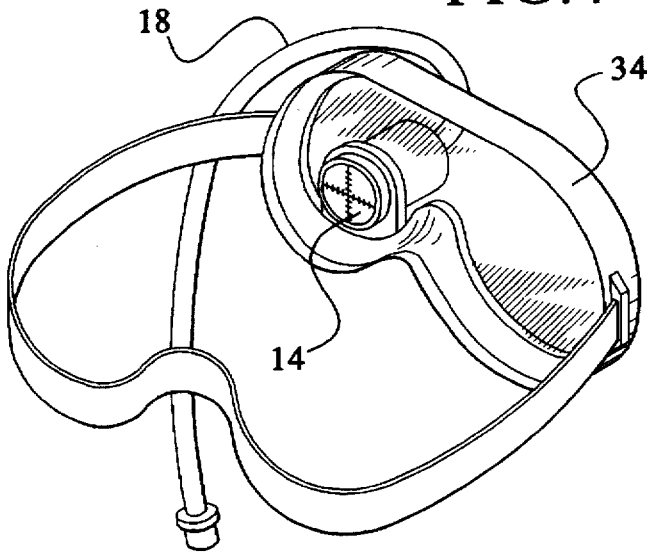
FIG. 4 illustrates a perspective view of an embodiment of a visual display mounted to goggles for the visual aiming system of the present invention.

Referring now to FIGS. 3 and 4, headgear with incorporated viewing displays for the visual aiming system 10 are illustrated. In FIG. 3, a helmet 28 is illustrated having a display 30 attached thereto via a mounting bracket 32. The display 30 allows the user 1 wearing the helmet 28 to view an image transmitted from the camera 12 and projected on the display 30. The embodiment illustrated in FIG. 3 requires wireless transmission of the image signal which will be shown and described hereinafter with reference to FIG. 5.

FIG. 4 illustrates goggles 34 on which a viewing display 14 is projected through coaxial cable 18 that extends to the firearm 2 with the visual aiming system 10 mounted thereto. Preferably, a display 14 is provided with a red dot site on a face of the display 14 facing the user that corresponds to the aimed position of the firearm 2. As a result, a field of view for the system 10 is provided on the display 14 with, for example, a red dot indicating the aimed target of the firearm 2. Conventional red dot sites may be implemented by those skilled in the art, such as the red dot aiming system manufactured by Aimpoint, Inc.

Figure 5:
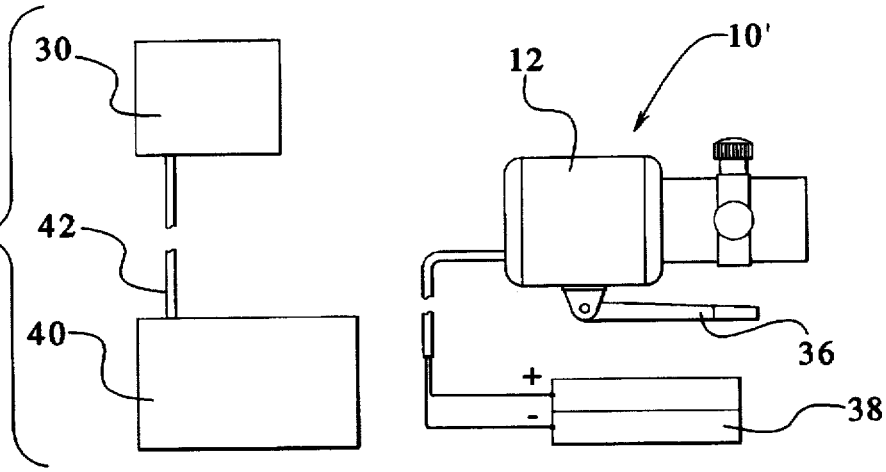
FIG. 5 illustrates a diagram of an embodiment of the visual aiming system of the present invention using remote wireless transmission.

FIG. 5 illustrates a modification of the visual aiming system 10 illustrated in FIG. 1. The visual aiming system 10' illustrated in FIG. 5 includes the camera 12 with an antenna 36 attached thereto. Further, a power supply 38 is also illustrated that may be incorporated into the firearm 2 as illustrated in FIG. 2. A receiver 40 receives an image signal remotely transmitted by the camera 12 via the antenna 36. The receiver 40 may be worn by the user 1 and connected via a length of coaxial cable 42 to a display 30 such as that illustrated in FIG. 3. The receiver 40 may, in the alternative, be incorporated with the display 30 such that attachment via coaxial cable 42 is not required. The system 10 illustrated in FIG. 1 and 4 may also be implemented using remote transmission via an antenna transmitting to a receiver carried by the user.

Figure 6:
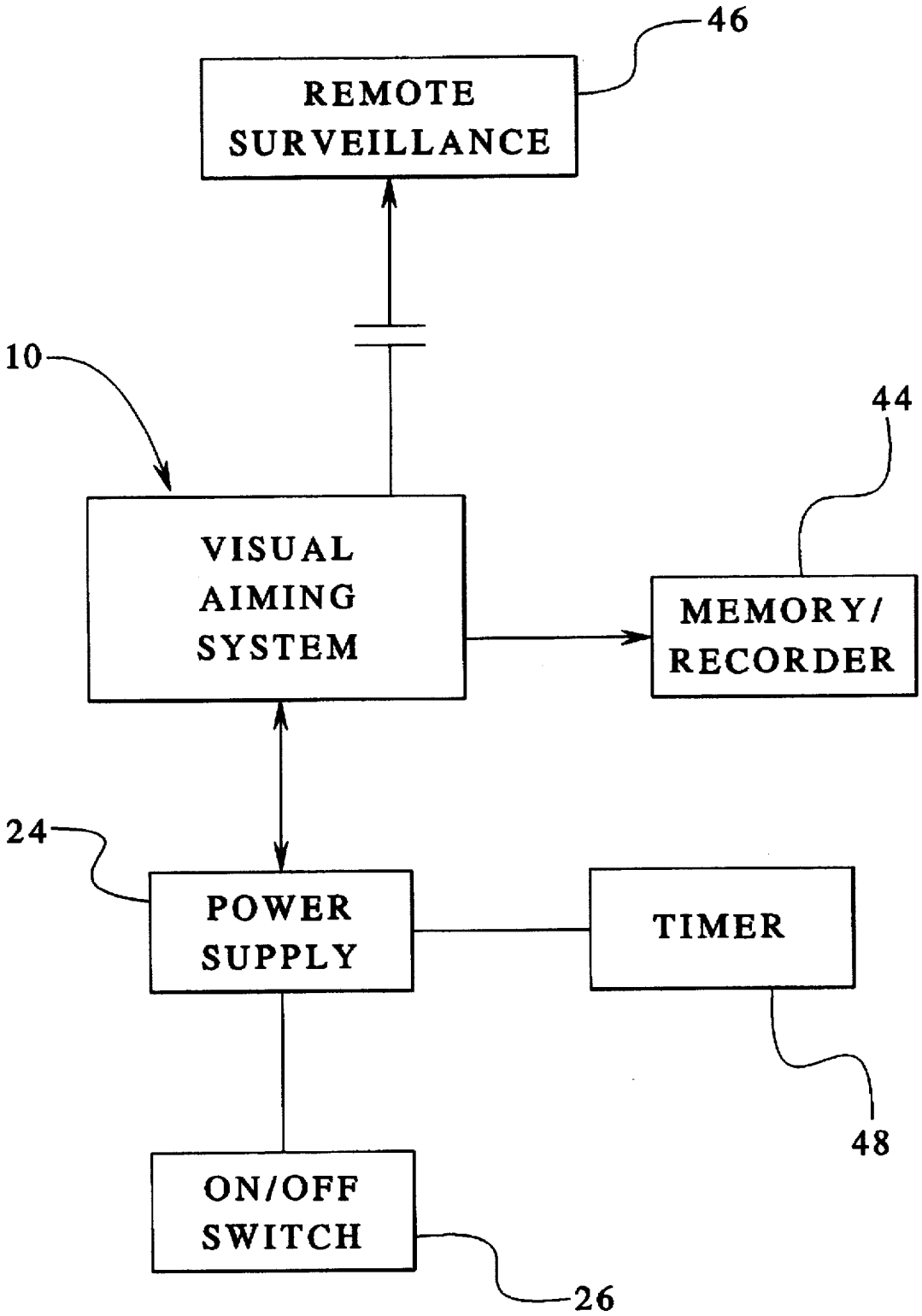
FIG. 6 illustrates a black box diagram of an embodiment of the visual aiming system of the present invention.

Additional features of the visual aiming system 10 of the present invention are illustrated with reference to FIG. 6. As shown, the visual aiming system 10 may transmit a signal produced from the camera 14 to a memory or recorder 44 for subsequent playback of the same. In addition, the signal may also be transmitted to remote surveillance equipment 46 such that the image signal may be viewed by another individual besides the user 1. The on/off switch 26 allows the system 10 to operate continuously or intermittently. A timer 48 may also be incorporated to selectively activate or to selectively deactivate the power supply 24 that provides power to the system 10.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An aiming system comprising:

a firearm having a barrel;

a camera mounted to the firearm along an axis parallel to the barrel;

transmission means associated with the camera for transmitting an image from the camera;

display means remote from the transmission means for viewing the transmitted image; and memory means for storing the image transmitted from the camera.

2. The system of claim 1 further comprising:

goggles on which the display means is attached wherein the goggles are worn by an individual carrying the firearm.

3. The system of claim 1 further comprising:

a helmet on which the display means is attached wherein the helmet is worn by an individual carrying the firearm.

4. The system of claim 1 further comprising:

a cable between the transmission means and the display means for transmitting the image.

5. The system of claim 1 further comprising:

an antenna attached to the camera; and a receiver means attached to an individual carrying the firearm receiving a signal transmitted by the antenna relating to the image from the camera.

6. The system of claim 1 further comprising:

surveillance means remote from the firearm capable of receiving the image from the camera.

7. The system of claim 1 further comprising:

a switch connected to the firearm that selectively initiates operation of the camera.

8. The system of claim 2 wherein vision through the goggles is only partially obstructed by the display means.

9. The system of claim 1 wherein the camera is removable from the firearm for attachment to another firearm.

10. A method for aiming a firearm carried by a user, the method comprising the steps of:

providing a camera;

attaching the camera to the firearm providing a line of sight and an image signal corresponding thereto;

transmitting the image signal from the camera;

displaying the image signal transmitted at a location remote from the camera; and recording the transmitted image signal for subsequent playback.

11. The method of claim 10 further comprising the step of:

providing headgear worn by the user of the firearm wherein the transmitted image signal is displayed proximate the headgear.

12. The method of claim 11 wherein the headgear is goggles.

13. The method of claim 11 wherein the headgear is a helmet.

14. The method of claim 10 further comprising the step of:

monitoring the image signal at a remote location from the firearm and the user.

15. The method of claim 10 further comprising the step of:

selectively activating operation of the camera.

16. The method of claim 10 wherein the transmitting is via wireless transmission.

* * * * *